US009414440B2

(12) United States Patent
Haruta et al.

(10) Patent No.: US 9,414,440 B2
(45) Date of Patent: Aug. 9, 2016

(54) HEATING ROLLER, THERMAL FIXING APPARATUS AND METHOD FOR PRODUCING HEATING ROLLER

(71) Applicant: Brother Kogyo Kabushiki Kaisha, Nagoya-shi, Aichi-ken (JP)

(72) Inventors: Kotaro Haruta, Yokkaichi (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/547,797

(22) Filed: Nov. 19, 2014

(65) Prior Publication Data

US 2015/0147102 A1 May 28, 2015

(30) Foreign Application Priority Data

Nov. 25, 2013 (JP) ..... 2013-242697

(51) Int. Cl.
*G03G 15/20* (2006.01)
*H05B 3/00* (2006.01)

(52) U.S. Cl.
CPC ..... *H05B 3/0095* (2013.01); *G03G 15/2057* (2013.01)

(58) Field of Classification Search
CPC ..... G03G 15/2057; G03G 15/206
See application file for complete search history.

(56) References Cited

U.S. PATENT DOCUMENTS 4,780,078 A * 10/1988 Masui ..... G03G 15/2053 219/216
2009/0129797 A1* 5/2009 Suzuki ..... G06G 15/657 399/44
2014/0314458 A1* 10/2014 Mitani ..... G03G 15/2017 399/329

FOREIGN PATENT DOCUMENTS

JP S61-153179 A 7/1986
JP S62-211262 A 9/1987
JP H09-304964 A 11/1997
JP 2004-212627 A 7/2004

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

A heating roller includes: a core bar having a cylindrical shape; a rubber layer arranged on an outer circumferential surface of the core bar; and a release layer arranged on an outer circumferential surface of the rubber layer, wherein when thermally fixing a developer on a recording medium, the heating roller is heated to a temperature within a fixing temperature range including a minute particle-scattering start temperature at which minute particles start to scatter from the rubber layer. The heating roller is arranged inside a casing which is connected to a minute particle density measuring device; then the core bar of the heating roller inside the casing is heated to 230° C. by a heater; and when the density of the minute particles inside the casing is measured after elapse of 20 minutes since start of the heating, the density of the minute particles is less than 2,000 pieces/cm$^3$.

5 Claims, 8 Drawing Sheets

HEATING ROLLER, THERMAL FIXING APPARATUS AND METHOD FOR PRODUCING HEATING ROLLER

CROSS REFERENCE TO RELATED APPLICATION

The present application claims priority from Japanese Patent Application No. 2013-242697 filed on Nov. 25, 2013 the disclosure of which is incorporated herein by reference in its entirety.

BACKGROUND OF THE INVENTION

1. Field of the Invention

The present invention relates to a heating roller provided on an image forming apparatus adopting the electro-photographic system, a thermal fixing apparatus provided with the heating roller, and a method for producing a heating roller.

2. Description of the Related Art

A printer adopting the electro-photographic system is provided with a fixing apparatus configured to fix an image of toner (toner image) transferred from a photosensitive drum to a paper (paper sheet). The fixing apparatus is provided with a heating roller and a pressing roller which is brought into pressurized contact with the heating roller.

As an example of such a heating roller, there is proposed a heating roller provided with a hollow roller core bar (mandrel), an elastic layer arranged on a surface of the hollow roller core bar, and a fluororesin tube arranged on the elastic layer (see, for example, Japanese Patent Application Laid-open No. H09-304964).

Further, the heating roller as described above is heated by a heater arranged inside the heating roller. When a paper onto which a toner image has been transferred passes between the heating roller and the pressing roller, this heating roller heats the toner image so as to fix the toner image to the paper.

SUMMARY OF THE INVENTION

With respect to the heating roller described in Japanese Patent Application Laid-open No. H09-304964, when the heating roller is heated by the heater, minute particles (fine particles) of which mean particle size is not more than 300 nm scatter (drift) from the elastic layer in some cases. In the recent years, the scattering of such minute particles is desired to be suppressed.

In view of such a situation, an object of the present teaching is to provide a heating roller capable of suppressing the scattering of minute particles of which mean particle size is not more than 300 nm, a thermal fixing apparatus provided with the heating roller, and a method for producing the heating roller.

According to a first aspect of the present teaching, there is provided a heating roller including: a core bar having a cylindrical shape; a rubber layer arranged on an outer circumferential surface of the core bar to cover the core bar; and a release layer arranged on an outer circumferential surface of the rubber layer, wherein in a case that a developer is thermally fixed on a recording medium, the heating roller is heated to a temperature within a fixing temperature range including a minute particle-scattering start temperature at which minute particles having mean particle diameter of not more than 300 nm start to scatter from the rubber layer; and density of the minute particles measured by a test is less than 2,000 pieces/cm$^3$, the test being executed by: arranging the heating roller inside a casing of which inner volume is 0.175 m$^3$ and which is connected to a minute particle density measuring device configured to measure the density of the minute particles; then performing heating of the core bar of the heating roller inside the casing to 230° C. by a heater; and then measuring the density of the minute particles inside the casing after elapse of 20 minutes since start of the heating of the core bar.

According to such a configuration, the density of the minute particles of which mean particle size is not more than 300 nm, measured by the test is less than 2,000 pieces/cm$^3$, which makes it possible to suppress the scattering of the minute particles from the rubber layer in a case that the heating roller is heated to a temperature within the fixing temperature range so as to thermally fix the developer to the recording medium.

According to a second aspect of the present teaching, there is provided a thermal fixing apparatus including: a heating roller including: a core bar having a cylindrical shape; a rubber layer arranged on an outer circumferential surface of the core bar to cover the core bar; and a release layer arranged on an outer circumferential surface of the rubber layer; and a heating member arranged inside the core bar of the heating roller and configured to heat the heating roller to a temperature of less than 230° C., wherein in a case that a developer is thermally fixed on a recording medium, the heating roller is heated to a temperature within a fixing temperature range including a minute particle-scattering start temperature at which minute particles having mean particle diameter of not more than 300 nm start to scatter from the rubber layer; and density of the minute particles measured by a test is less than 2,000 pieces/cm$^3$, the test being executed by: arranging the heating roller inside a casing of which inner volume is 0.175 m$^3$ and which is connected to a minute particle density measuring device configured to measure the density of the minute particles; then performing heating of the core bar of the heating roller inside the casing to 230° C. by a heater; and then measuring the density of the minute particles inside the casing after elapse of 20 minutes since start of the heating of the core bar.

According to such a configuration, since the thermal fixing apparatus is provided with the heating roller, it possible to suppress the scattering of the minute particles from the rubber layer of the heating roller in a case that the heating roller is heated by the heating member to a temperature within the fixing temperature range so as to thermally fix the developer to the recording medium.

According to a third aspect of the present teaching, there is provided a method for producing a heating roller, the method including the steps of: preparing a core bar; forming a resin composite layer formed of a resin composite on an outer circumferential surface of the core bar so as to cover the core bar; performing primary curing of the resin composite layer at a temperature in a range of not less than 25° C. to not more than 150° C. for a duration of time in a range of not less than 0.5 hours to not more than 4 hours; preparing a rubber layer based on the resin composite layer by performing secondary curing of the resin composite layer, after the primary curing, at a temperature in a range of not less than 150° C. to not more than 230° C. for a duration of time in a range of not less than 0.5 hours to not more than 10 hours; forming a release layer on an outer circumferential surface of the rubber layer to cover the rubber layer to thereby obtain a roller member including the core bar, the rubber layer and the release layer; and heating the roller member at a temperature in a range of not less than 200° C. to not more than 250° C. for a duration of time in a range of not less than 1 hour to not more than 20 hours to thereby obtain the heating roller.

According to such a configuration, the resin composite layer is subjected to the second curing so as to prepare the rubber layer; and then the roller member provided with the core bar, the rubber layer and the release layer is heated at a temperature in a range of not less than 200° C. to not more than 250° C. for a duration of time in a range of not less than 1 hour to not more than 20 hours. In this case, the minute particles of which mean particles size is not more than 300 nm are scattered from the rubber layer when the roller member is heated.

Namely, in the method for producing the heating roller, the minute particles of which mean particles size is not more than 300 nm are scattered in advance from the rubber layer in the production step of the heating roller. Thus, in the heating roller produced by this production method, the scattering of the minute particles from the rubber layer is suppressed when the heating roller is heated to a temperature within the fixing temperature range.

Thus, according to the method for producing the heating roller of the present teaching, it is possible to produce the heating roller wherein the scattering of minute particles of which mean particle size is not more than 300 nm is suppressed when the heating roller is heated to a temperature within the fixing temperature range.

BRIEF DESCRIPTION OF THE DRAWINGS

FIGS. 4A to 4C are process views for explaining a method for producing a heating roller shown in FIG. 3, wherein FIG. 4A illustrates a step of preparing a metal raw pipe (metal pipe stock); FIG. 4B illustrates a step of forming a resin composite layer on the outer circumferential surface of the metal raw pipe; and FIG. 4C illustrates a step of curing the resin composite layer to thereby prepare a rubber layer.

FIGS. 5A and 5B are process views for explaining the method for producing the heating roller, continued from that of FIG. 4C, wherein FIG. 5A illustrates a step of forming a coating layer on the outer circumferential surface of the rubber layer, to thereby obtain a roller member provided with the metal raw pipe, the rubber layer and the coating layer; and FIG. 5B illustrates a step of heating the roller member.

DESCRIPTION OF THE PREFERRED EMBODIMENTS

<Overall Configuration of Printer>

Figure 1:
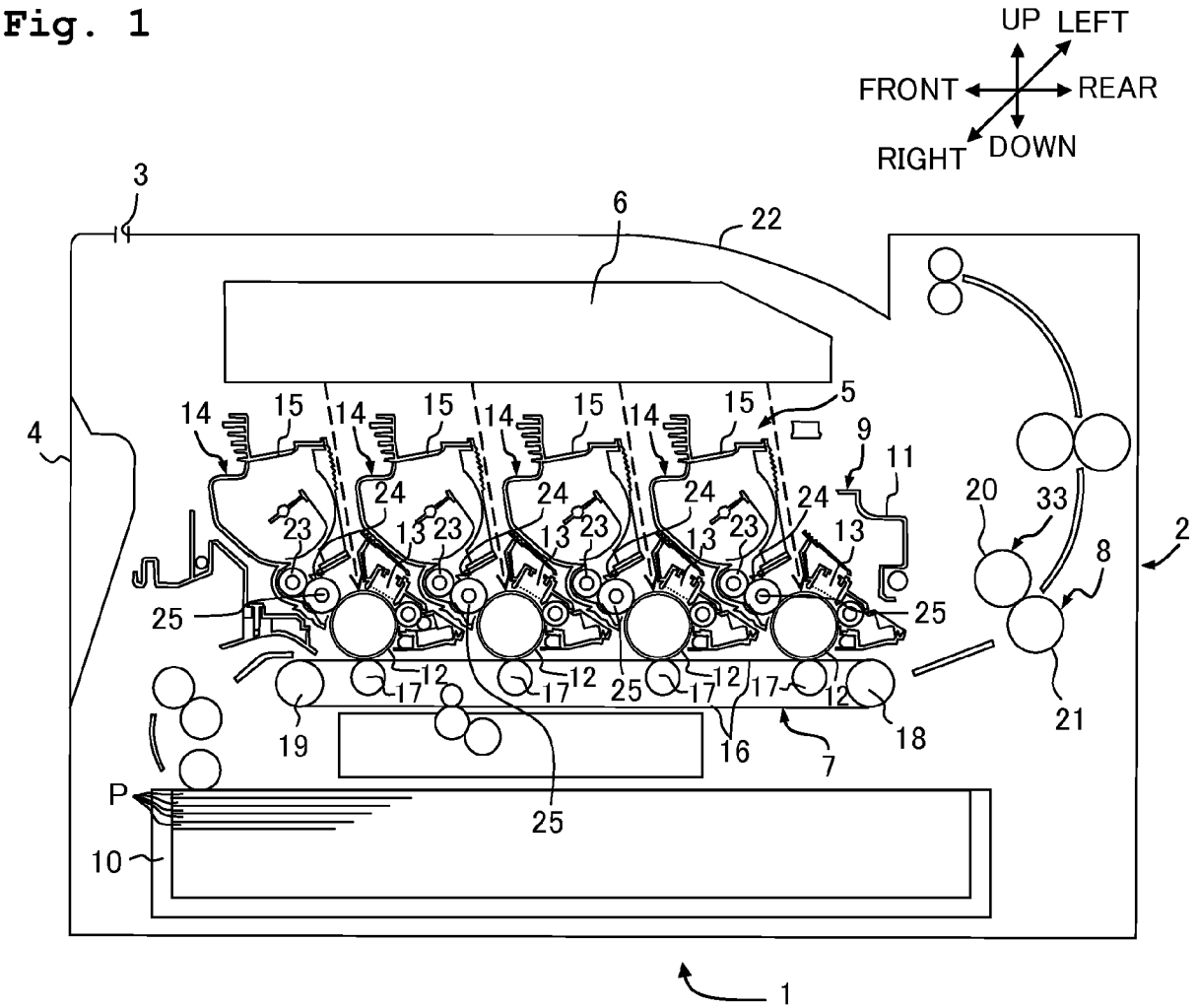
FIG. 1 is a central cross-sectional view of a printer provided with a heating roller as an embodiment of the present teaching.
Figure 2:
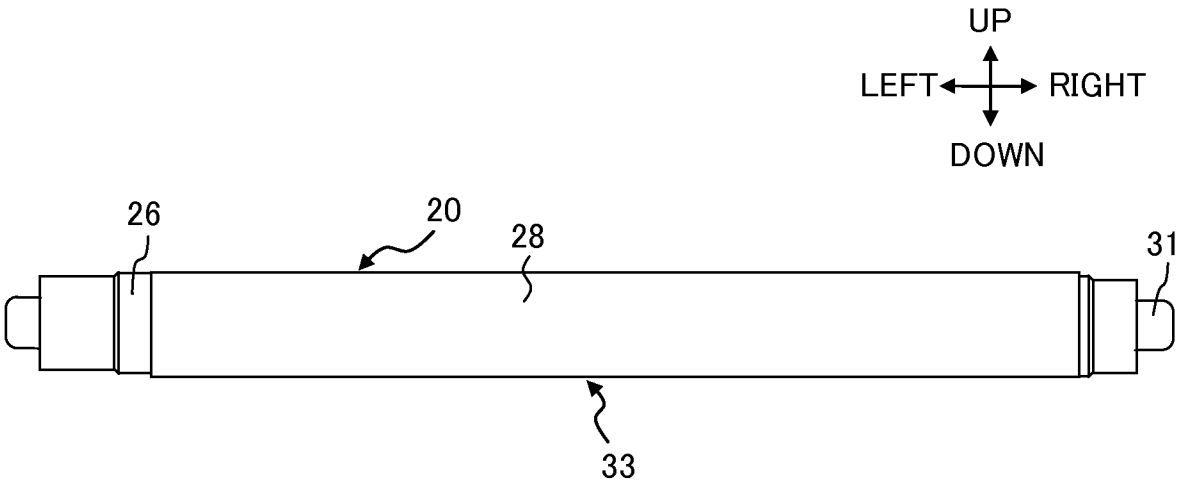
FIG. 2 is a front view of a heating unit shown in FIG. 1.

As shown in FIG. 1, a printer 1 is a direct-tandem type horizontal color printer.

The printer 1 is provided with a body casing 2, a process unit 5, a scanner unit 6, a transfer unit 7 and a fixing unit 8.

The body casing 2 has a box-like shape that is substantially rectangular in a side view, and accommodates the process unit 5, the scanner unit 6, the transfer unit 7 and the fixing unit 8 inside the body casing 2.

Further, the body casing 2 has an opening 3, a front cover 4, a paper supply tray 10 and a paper discharge tray 22.

Note that in the following explanation, the front/rear direction is defined with reference to that a side on which the front cover 4 of the printer 1 is provided is the near side (front side), and the left/right direction is defined with reference to that the printer 1 is viewed from the near side (front side). Namely, in FIG. 1, the left side of the sheet surface of FIG. 1 is the front side, the right side of the sheet surface is the rear side, and the near side of the sheet surface is the right side and the far side of the sheet surface is the left side. Specifically, the respective directions are indicated by arrows in each of the drawings. Further, the up/down direction is the vertical direction, and the front/rear direction and the left/right direction are each the horizontal direction.

The opening 3 is formed at a front end portion of the body casing 2. The front cover 4 is pivotably supported by a lower end portion of the front wall of the body casing 2 with a lower end portion of the front cover 4 as the pivot point. The front cover 4 opens or closes the opening 3.

The paper supply tray 10 is detachably provided inside the body casing 2 on a bottom portion of the body casing 2. The paper feed tray 10 is configured to accommodate a paper P, as an example of the recording medium, in the paper feed tray 10.

The paper discharge tray 22 is arranged at the upper wall of the body casing 2. The paper discharge tray 22 is recessed downward from the upper wall of the body casing 2 so that a paper P is placed on the paper discharge tray 22.

The process unit 5 is arranged inside the body casing 2 at a substantially central location in the up/down direction of the body casing 2. The process unit 5 is configured to be installable or removable with respect to the body casing 2 via the opening 3.

The process unit 5 is provided with a drawer unit 9 and a developing cartridge 14.

The drawer unit 9 is provided with a drawer frame 11, a photosensitive drum 12 and a scorotron charger 13.

The drawer frame 11 has a frame-like shape which is substantially rectangular in a plane view.

The photosensitive drum 12 is provided as a plurality of photosensitive drums 12 corresponding to a plurality of colors, respectively. Specifically, four photosensitive drums 12 are provided corresponding to four colors that are yellow, magenta, cyan and black colors, respectively. The four photosensitive drum 12 are arranged in parallel inside the drawer frame 11 at a lower end portion thereof, with a spacing distance between the photosensitive drums 12 in the front/rear direction.

Each of the photosensitive drums 12 has a substantially cylindrical shape extending in the left/right direction. The photosensitive drums 12 are rotatably supported by lower end portions in the both side walls of the drawer frame 11 such that a lower end portion of each of the photosensitive drums 12 is exposed from the drawer frame 11.

The scorotron charger 13 is provided as a plurality of, specifically four pieces of, scorotron chargers 13 corresponding to the plurality of photosensitive drums 12, respectively. The scorotron chargers 13 are arranged, with a spacing distance therebetween, on the upper rear side with respect to the photosensitive drums 12 corresponding thereto, respectively.

The developing cartridge 14 is provided as a plurality of, specifically four pieces of, developing cartridges 14 corresponding to the plurality of photosensitive drums 12, respectively. Each of the developing cartridges 14 is configured to be installable or removable with respect to the drawer frame 11.

The developing cartridges 14 are arranged at positions above and in front of the photosensitive drums 12 corresponding thereto, respectively, in a state that the developing cartridges 14 are installed to the drawer frame 11.

Each of the developing cartridges 14 is provided with a developing frame 15, a developing roller 25, a supply roller 23 and a layer-thickness regulating blade 24.

The developing frame 15 has a substantially box-like shape extending in the left/right direction. A rear side portion of the lower end portion of the developing frame 15 is open in a downward and rearward direction. The developing frame 15 is configured to accommodate a toner as an example of the developer. Such a toner is exemplified by a non-magnetic one-component polymerized toner, etc.

The developing roller 25 is arranged inside the developing frame 15 at a lower end portion of the developing frame 15, and is rotatably supported by the developing frame 15. A rear side portion of the lower end portion of the developing roller 25 is exposed from the developing frame 15 and makes contact with a front side portion of the upper end portion of the photosensitive drum 12.

The supply roller 23 is arranged at a position above and in front of the developing roller 25. A rear side portion of the lower end portion of the supply roller 23 makes contact with a front side portion of the upper end portion of the developing roller 25.

The layer-thickness regulating blade 24 is arranged at a position above the developing roller 25. A front end portion of the layer-thickness regulating blade 24 makes contact with an upper end portion of the developing roller 25.

The scanner unit 6 is arranged to be located above the process unit 5, in the body casing 2. The scanner unit 6 is configured to emit a laser beam based on data of an image toward each of the photosensitive drums 12.

The transfer unit 7 is arranged to be located below the process unit 5, in the body casing 2. The transfer unit 7 is provided with a driving roller 18, a driven roller 19, a transport belt 16 and a transfer roller 17.

The driving roller 18 and the driven roller 19 are arranged in the front/rear direction with a spacing distance therebetween. The transport belt 16 is wound around and stretched between the driving roller 18 and the driven roller 19 such that a portion (upper portion) of the transport belt 16, which is located on the upper side during the below-described circulating movement of the transport belt 16, makes contact with the plurality of photosensitive drums 12 from therebelow. Further, the transport belt 16 makes circulating movement by the driving of the driving roller 18 and the driven motion of the driven roller 19 such that the upper portion, of the transport belt 16 contacting with the photosensitive drums 12, moves in the front-to-rear side direction.

The transfer roller 17 is provided as a plurality of, specifically four pieces of, transfer rollers 17 corresponding to the plurality of photosensitive drums 12, respectively. Each of the transfer rollers 17 is arranged to be below one of the photosensitive drums 12 corresponding thereto such that the transfer roller 17 pinches the upper portion of the transport belt 16 with the photosensitive drum 12 corresponding thereto.

The fixing unit 8 is arranged at a position above and behind the transfer unit 7 and behind the process unit 5. The fixing unit 8 is provided with a heating unit 33 as an example of the thermal fixing apparatus and a pressing roller 21.

The heating unit 33 is provided with a heating roller 20, as will be described in detail later on.

As shown in FIG. 1, the pressing roller 21 is arranged at a position below and behind the heating roller 20 such that a front side portion of the upper end portion of the pressing roller 21 makes contact with a rear side portion of the lower end portion of the heating roller 20.

<Image-Forming Operation of Printer 1>

Next, an image forming operation of the printer 1 will be explained. Note that in the image forming operation as follows is executed under the control of an unillustrated controller.

<Developing Operation>

When the printer 1 starts the image forming operation, each of the scorotron chargers 13 uniformly charges the surface of one of the photosensitive drums 12 corresponding thereto and then the scanner unit 6 exposes the charged surfaces of the photosensitive drums 12, based on a predetermined image data. With this, an electrostatic latent image based on the image data is formed on the surface of each of the photosensitive drums 12.

Further, the toner inside the developing frame 15 is supplied to the supply rollers 23. Each of the supply rollers 23 supplies the toner to one of the developing rollers 25 corresponding thereto. Then, the supply roller 23 and the developing roller 25 frictionally charge the toner supplied therebetween to the positive polarity. Next, the layer-thickness regulating blade 24 regulates the thickness of the toner supplied to the developing roller 25 to a predetermined (constant) thickness. Then, the developing roller 25 rotates to thereby supply the toner held on the developing roller 25 to the electrostatic latent image formed on the circumferential surface of the photosensitive drum 12. With this, an image of the toner (toner image) is held on the circumferential surface of the photosensitive drum 12.

<Paper Supplying Operation and Transferring Operation>

By the rotation of the respective rollers, papers P accommodated in the paper feed tray 10 are supplied one by one from the paper feed tray 10, at a predetermined timing, to a space between the photosensitive drum 12 and the transport belt 16.

Next, the transport belt 16 transports a paper P supplied between the photosensitive drum 12 and the transport belt 16 in the front-to-rear side direction. At this time, each of the photosensitive drums 12 and one of the transport rollers 17 corresponding thereto transport one of toner images of the respective colors onto the paper P passing therebetween and therethrough so that the toner images of the respective colors are formed on the paper P in a sequential manner. With this, a color image is formed on the paper P.

<Fixing Operation and Paper Discharge Operation>

Next, the paper P on which the color image is formed reaches a space between the heating roller 20 and the pressing roller 21 by the circulating movement of the transport belt 16. The heating roller 20 and the pressing roller 21 heat and press (apply pressure to) the paper P passing therebetween and therethrough. With this, the color image transferred to the paper P is thermally fixed to the paper P. Afterwards, the respective rollers transport the paper P so that the paper P makes a U-turn frontward and upward, thereby discharging the paper P to the paper discharge tray 22.

<Details of Heating Unit>

Figure 3:
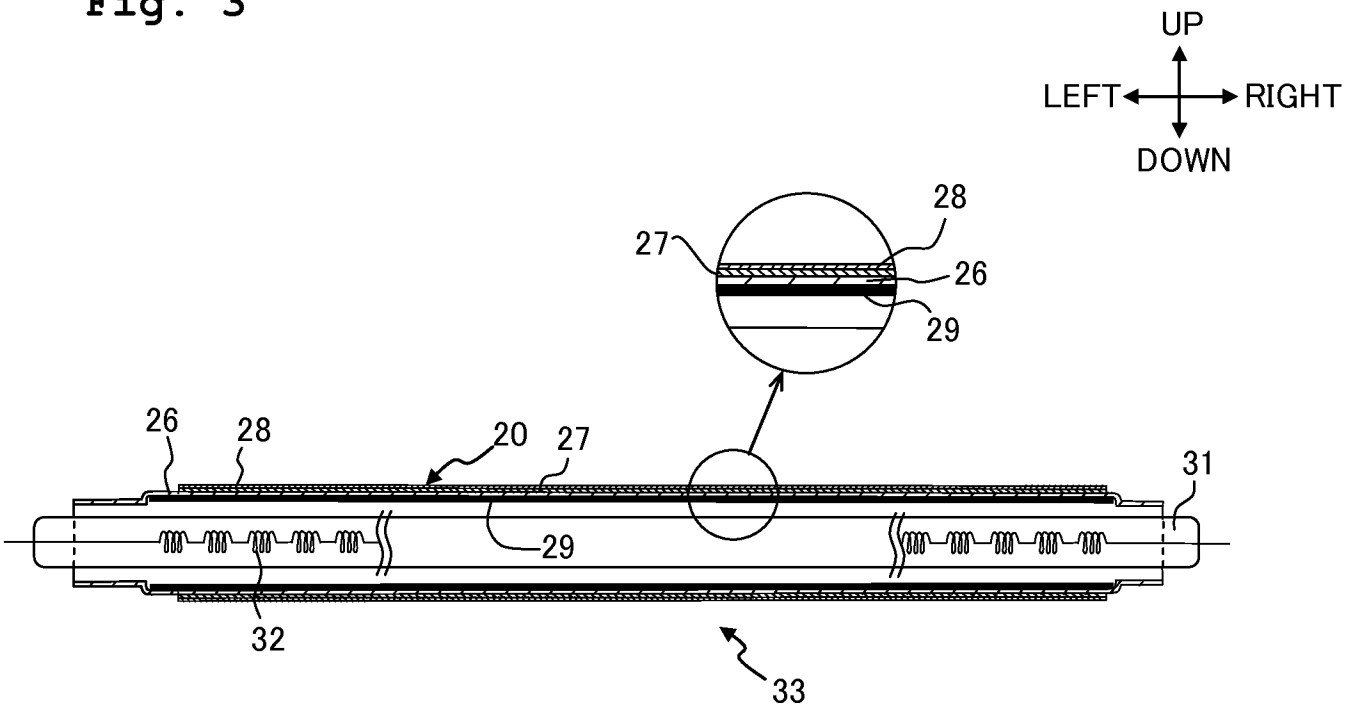
FIG. 3 is a front cross-sectional view of the heating unit shown in FIG. 2.

The heating unit 33 is provided with the heating roller 20, a halogen lamp 31 as an example of the heating member, as shown in FIG. 3, and an unillustrated temperature controller.

The heating roller 20 is provided with a metal raw pipe (metal pipe stock) 26 as an example of the core bar, a heat absorbing layer 29, a rubber layer 27 and a coating layer 28 as an example of the release layer.

The metal raw pipe 26 is formed of a metal material such as aluminum, etc., and has a substantially cylindrical shape extending in the left/right direction. The size in the left/right direction of the metal raw pipe 26 is, for example, in a range of not less than 220 mm to not more than 300 mm, preferably in a range of not less than 240 mm to not more than 280 mm.

The heat absorbing layer 29 is formed, for example, of a black paint, etc., and is arranged on the inner circumferential surface of the metal raw pipe 26. The thickness of the heat absorbing layer 29 is, for example, in a range of not less than 5 μm to not more than 50 μm, preferably in a range of not less than 5 μm to not more than 20 μm. Further, the size in the left/right direction of the heat absorbing layer 29 is smaller than the size in the left/right direction of the metal raw pipe 26. Furthermore, the heat absorbing layer 29 covers the inner circumferential surface of the metal raw pipe 26 such that the both end portions in the left/right direction of the inner circumferential surface of the metal raw pipe 26 are exposed (are not covered by the heat absorbing layer 29).

The rubber layer 27 is formed, for example, of a rubber material such as silicone rubber, fluoro rubber, etc., and is preferably formed of silicone rubber in view of the heat-resisting property. The rubber layer 27 is arranged on the outer circumferential surface of the metal raw pipe 26, and has a substantially cylindrical shape extending in the left/right direction. The thickness of the rubber layer 27 is, for example, in a range of not less than 0.1 mm to not more than 1.0 mm, preferably in a range of not less than 0.3 mm to not more than 0.8 mm. Further, the size in the left/right direction of the rubber layer 27 is smaller than the size in the left/right direction of the metal raw pipe 26, and is, for example, in a range of not less than 210 mm to not more than 260 mm, preferably in a range of not less than 220 mm to not more than 250 mm. Furthermore, the rubber layer 27 covers the outer circumferential surface of the metal raw pipe 26 such that the both end portions in the left/right direction of the outer circumferential surface of the metal raw pipe 26 are exposed (are not covered by the rubber layer 27).

The coating layer 28 is formed, for example, of a resin material such as fluororesin, silicone resin, etc. The fluororesin is preferred among such resin materials. Specific examples of the fluororesin includes polytetrafluoroethylene (PTFE), tetrafluoroethylen-perfluoroalkylvinylether copolymer (PFA), tetrafluoroethylene-hexafluoroethylene copolymer (FEP), tetrafluoroethylene-ethylene copolymer (ETFE), difluoroethylene polymer (PVdF), etc., among which the PFA is preferred. Such a resin material may be used singly, or two or more kinds of the resin material may be used in combination.

The coating layer 28 is arranged on the outer circumferential surface of the rubber layer 27 and has a substantially cylindrical shape extending in the left/right direction. The thickness of the coating layer 28 is, for example, in a range of not less than 20 μm to not more than 100 μm, preferably in a range of not less than 30 μm to not more than 90 μm. Further, the size in the left/right direction of the coating layer 28 is substantially same as the size in the left/right direction of the rubber layer 27. Furthermore, the coating layer 28 covers the outer circumferential surface of the rubber layer 27 such that the rubber layer 27 is entirely covered by the coating layer 28 in the left/right direction.

The halogen lamp 31 has a substantially cylindrical shape extending in the left/right direction. The size in the left/right direction of the halogen lamp 31 is greater than the size in the left/right direction of the metal raw pipe 26, and the outer diameter of the halogen lamp 31 is smaller than the inner diameter of the metal raw pipe 26. Further, the halogen lamp 31 is arranged inside the metal raw pipe 26 such that the both end portions in the left/right direction of the halogen lamp 31 project from the metal raw pipe 26 in the left/right direction.

Furthermore, the halogen lamp 31 is provided with a filament 32. The filament 32 is arranged inside the halogen lamp 31 in the left/right direction such that the filament 32 is overlapped with the heat absorbing layer 29 when the filament 32 is projected in the radial direction of the metal raw pipe 26.

The unillustrated temperature controller is configured to be capable of detecting the surface temperature of the heating roller 20, and of controlling the output of the halogen lamp 31.

<Minute Particle Scattering Test of Heating Roller>

Figure 6:
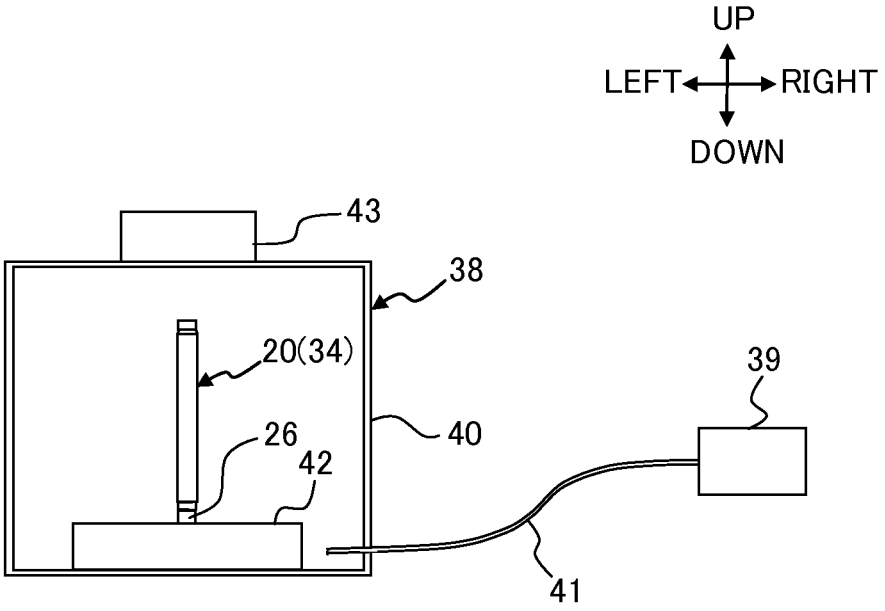
FIG. 6 is a view for explaining a heating test for the heating roller shown in FIG. 2.

As shown in FIG. 6, the heating roller 20 is subjected to measurement for measuring the scattering density of the minute particles by a minute particle scattering test as an example of the test; and the measured scattering density of the minute particles is, for example, in a range of not less than 100 pieces/$cm^3$ to less than 2,000 pieces/$cm^3$, preferably in a range of not less than 100 pieces/$cm^3$ to less than 1,900 pieces/$cm^3$, more preferably in a range of not less than 100 pieces/$cm^3$ to less than 1,700 pieces/$cm^3$.

The term "minute particles" referred herein means minute particles which scatter (fly or drift) from the rubber layer 27 when the heating roller 20 is heated and of which mean particle size is not more than 300 nm. Note that in the following explanation, the minute particles which scatter from the rubber layer 27 and of which mean particle size is not more than 300 nm is simply described as "minute particles".

More specifically, the mean particle size of the minute particles is in a range of not less than 5 nm to not more than 300 nm, preferably in a range of not less than 10 nm to not more than 250 nm. The mean particle size of such minute particles can be measured by a fast-response particle sizer (model name: FMPS (Fast Mobility Particle Sizer), manufactured by TOKYO DYLEC CORPORATION).

The scattering density (piece/$cm^3$) of such minute particles is the number of pieces of the minute particles which are present in a space of 1 $cm^3$, and is measured, for example, by a measuring unit 38.

The measuring unit 38 is provided with a casing 40, a particle density measuring device 39 as an example of the minute particle density measuring device, a communicating tube 41, a hot plate 42 as an example of the heater, and an air cleaner 43.

The casing 40 has a box-like shape that is substantially rectangular in a side view. The size in the left/right direction of the casing 40 is, for example, in a range of not less than 40 cm to not more than 80 cm, specifically 50 cm; the size in the front/rear direction of the casing 40 is, for example, in a range of not less than 60 cm to not more than 100 cm, specifically 70 cm; the size in the up/down direction of the casing 40 is, for example, in a range of not less than 40 cm to not more than 80 cm, specifically 50 cm. Further, the internal cubic volume of the casing 40 is 0.175 $m^3$.

The particle density measuring device 39 is configured to measure the scattering density of minute particles (piece/$cm^3$) inside the casing 40. As the above-described particle density measuring device 39, it is possible to use any commercially available device which is exemplified by, for example, a portable condensed particle counter: model name "CPC 3007" manufactured by TOKYO DYLEC CORPORATION, and the like.

The communicating tube 41 has a tubular shape, and communicates the particle density measuring device 39 and the casing 40. Specifically, an end portion of the communicating tube 41 is connected to the casing 40 so as to face the inside of the casing 40, and the other end portion of the communicating tube 41 is connected to the particle density measuring device 39. In such a manner, the casing 40 is connected to the particle density measuring device 39 via the communicating tube 41.

The hot plate 42 is arranged inside the casing 40 at a bottom portion of the casing 40. The hot plate 42 is configured such that the upper surface of the hot plate 42 is heated to a temperature within a temperature range, for example, of not less than 25° C. to not more than 300° C.

The air cleaner 43 is arranged on the upper surface of the upper wall of the casing 40, and is configured to remove the minute particles inside the casing 40. As the above-described air cleaner 43, it is possible to use any commercially available device which is exemplified by, for example, PURE SPACE model name PS01-A manufactured by TANAKA SEIKI CO., LTD.

In order to measure the scattering density of minute particles (piece/$cm^3$) from the heating roller 20 with this measuring unit 38, an operator at first activates the air cleaner 43 and adjusts the scattering density of the minute particles inside the casing 40 to, for example, not less than 0 pieces/$cm^3$, and for example, not more than 100 pieces/$cm^3$, preferably not more than 5 pieces/$cm^3$. The scattering density of the minute particles in this situation is referred to as "initial scattering density of minute particles". Note that the scattering density of the minute particles inside the casing 40 is measured by the particle density measuring device 39.

Afterwards, the operator stops the air cleaner 43.

Further, the operator activates the hot plate 42 and heats the upper surface of the hot plate 42 to 230° C.

Then, the operator arranges the heating roller 20 on the hot plate 42 so that the axial direction of the heating roller 20 is along the up/down direction and an end surface in the axial direction of the metal raw pipe 26 makes contact with the heated upper surface of the hot plate 42.

With this, the metal raw pipe 26 of the heating roller 20 is heated to approximately 230° C. by the hot plate 42, and the rubber layer 27 of the heating roller 20 is also heated to approximately 230° C. via the metal raw pipe 26.

Next, when 20 minutes has elapsed since the start of the heating with respect to the heating roller 20, the scattering density of minute particles (piece/$cm^3$) inside the casing 40 is measured by the particle density measuring device 39. The scattering density of the minute particles inside the casing 40 in this situation is referred to as "after-heating scattering density of minute particles".

Then, the after-heating scattering density of minute particles is corrected by the initial scattering density of minute particles. Specifically, the initial scattering density of minute particles is subtracted from the after-heating scattering density of minute particles.

In the manner described above, the scattering density of minute particles (piece/$cm^3$) from the heating roller 20 is calculated.

<Method for Producing Heating Roller>

Figure 4A:
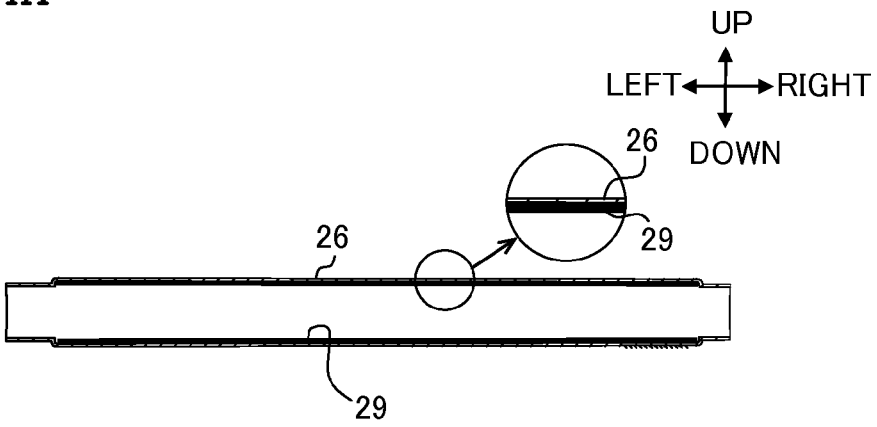

In order to produce such a heating roller 20, at first, a metal raw pipe 26 having a heat absorbing layer 29 arranged on the inner circumferential surface thereof is prepared, as shown in FIG. 4A.

Figure 4B:
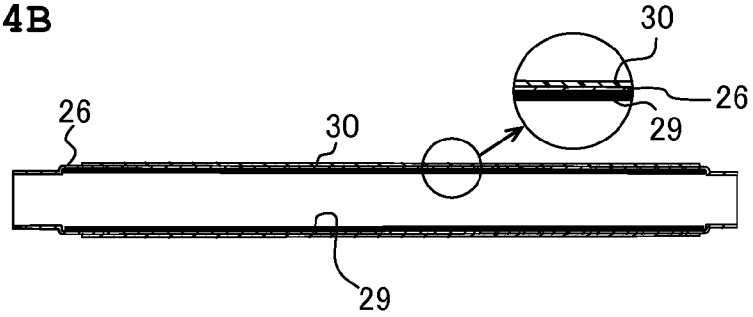

Next, a resin composite layer 30 is formed on the outer circumferential surface of the metal raw pipe 26 so as to cover the metal raw pipe 26 with the resin composite layer 30 as shown in FIG. 4B.

In order to form such a resin composite layer 30, for example, an unillustrated forming die is arranged so as to cover the outer circumferential surface of the metal raw pipe 26, and a resin composite is poured into the unillustrated forming die.

The resin composite contains at least a resin.

The resin is exemplified, for example, by a silicone resin, a fluororesin, a styrene-butadiene resin, a nitrile resin, an ethylene-propylene resin, etc. Among these, the silicone resin is preferred.

As the silicone resin, it is possible to use any commercially available product which is exemplified, for example, by a silicone rubber produced by SHIN-ETSU CHEMICAL CO., LTD., and the like.

Figure 4C:
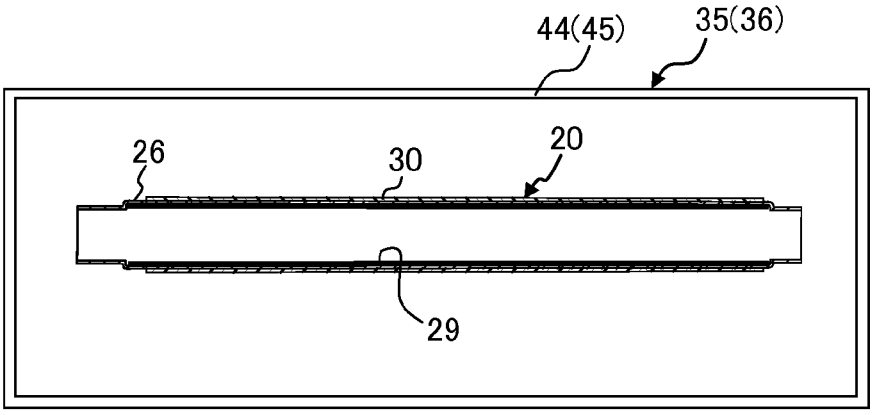

Next, as shown in FIG. 4C, the metal raw pipe 26 having the resin composite layer 30 formed on the outer circumferential surface thereof is heated by a first heater 35.

The first heater 35 is provided with a first casing 44 which has substantially box-like shape, and is configured to heat the inside of the first casing 44.

Accordingly, the metal raw pipe 26 is accommodated inside the first casing 44 and is heated by the first heater 35.

The heating temperature by the first heater 35 is, for example, a temperature in a range of not less than 25° C. to not more than 150° C., preferably in a range of not less than 30° C. to not more than 100° C.; the heating time (duration of heating time) by the first heater 35 is, for example, in a range of not less than 0.5 hours to not more than 4 hours, preferably in a range of not less than 1.0 hour to not more than 2 hours.

With this, the resin composite layer 30 undergoes primary curing. After that, the unillustrated forming die is removed.

Next, the metal raw pipe 26 in which the primary cured resin composite layer 30 is arranged on the outer circumferential surface of the metal raw pipe 26 is heated by a second heater 36, as shown in FIG. 4C. Note that although the second heater 36 may be same as or different from the first heater 35, it is preferable that the second heater 36 is different from the first heater 35 from the viewpoint of lowering the scattering density of the minute particles.

The second heater 36 is provided with a second casing 45 which has substantially box-like shape, and is configured to heat the inside of the second casing 45.

Accordingly, the metal raw pipe 26 is accommodated inside the second casing 45 and is heated by the second heater 36.

The heating temperature by the second heater 36 is, for example, in a range of not less than 150° C. to not more than 230° C., preferably in a range of not less than 200° C. to not more than 220° C.; the heating time (duration of heating time) by the second heater 36 is, for example, in a range of not less than 0.5 hours to not less than 10 hours, preferably in a range of not less than 2.0 hours to not more than 8 hours.

Figure 5A:
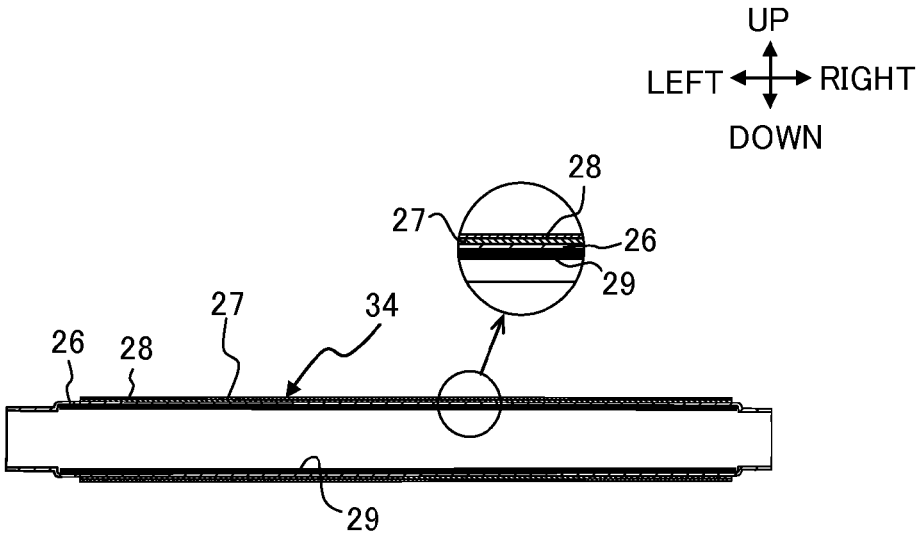

With this, the resin composite layer 30 after having undergone the primary curing is heated and undergoes secondary curing, and is prepared as a rubber layer 27, as shown in FIG. 5A.

Next, a coating layer 28 is formed on the outer circumferential surface of the rubber layer 27 so as to cover the rubber layer 27 with the coating layer 28.

In order to form the coating layer 28, at first, a coating layer 28 having a substantially cylindrical shape extending in the left/right direction is prepared separately. Then, the coating layer 28 is attached to the outer circumferential surface of the rubber layer 27 so that the coating layer 28 covers the rubber layer 27.

With this, a roller member 34 provided with the metal raw pipe 26, the rubber layer 27, the coating layer 28 and the heat absorbing layer 29 is prepared.

Figure 5B:
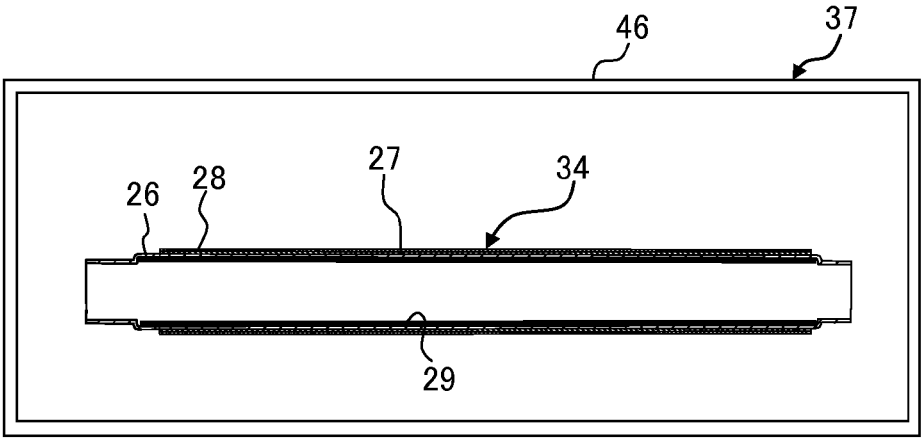

Next, the roller member 34 is heated as shown in FIG. 5B to a temperature that is not less than a minute particle-scattering start temperature at which the minute particles start to scatter. Namely, the roller member 34 is a heating roller 20 before being subjected to the heating process at a temperature that is not less than the minute particle-scattering start temperature.

Here, the term "minute particle-scattering start temperature" means a temperature at which the minute particles having the mean particle size of not more than 300 nm start to scatter in not less than predetermined amount from the rubber layer 27 of the roller member 34, and is measured, for example, by the measuring unit 38 as shown in FIG. 6.

In order to measure the minute particle-scattering start temperature by the measuring unit 38, the scattering density of the minute particles inside the casing 40 is adjusted preferably to not more than 5 pieces/$cm^3$, in a similar manner in the above-described minute particle scattering test. Then, the upper surface of the hot plate 42 is heated to a predetermined initial temperature, for example, a temperature in a range of not less than 140° C. to not more than 200° C., preferably in a range of not less than 170° C. to not more than 190° C.

Next, the roller member 34 is arranged on the hot plate 42 so that the axial direction of the roller member 34 is along the up/down direction and an end surface in the axial direction of the metal raw pipe 26 makes contact with the heated upper surface of the hot plate 42, followed by being stood still for 20 minutes. After 20 minutes has elapsed, the scattering density of minute particles (piece/$cm^3$) inside the casing 40 is measured by the particle density measuring device 39.

At this time, in a case that the scattering density of the minute particles is less than 5,000 pieces/$cm^3$, the temperature of the upper surface of the hot plate 42 is raised by a predetermined value, for example by 20° C., and the above-described operation is repeated.

Then, in a case that the scattering density of the minute particles exceeds 5,000 pieces/$cm^3$, a temperature obtained by subtracting a predetermined value (for example, 20° C.) from the temperature of the upper surface of the hot plate 42 at a point of time when the scattering density has exceeded 5,000 pieces/$cm^3$ is set to be the minute particle-scattering start temperature.

With this, the minute particle-scattering start temperature is measured by the measuring unit 38.

More specifically, the minute particle-scattering start temperature is, for example, in a range of not less than 150° C. to less than 230° C., preferably in a range of a temperature exceeding 150° C. to less than 230° C., more preferably in a range of not less than 200° C. to less than 220° C.

In order to heat the roller member 34 to a temperature not less than the minute particle-scattering start temperature, the roller member 34 is heated by a third heater 37 as shown in FIG. 5B.

The third heater 37 is provided with a third casing 46 which has substantially box-like shape, and is configured to heat the inside of the third casing 46. Note that although the third heater 37 may be same as or different from the second heater 36, it is preferable that the third heater 37 is different from the second heater 36 from the viewpoint of lowering the scattering density of the minute particles.

Accordingly, the roller member 34 is accommodated inside the third casing 46 and is heated by the third heater 37.

The heating temperature by the third heater 37 is, for example, in a range of not less than 160° C. to not more than 250° C., preferably in a range of not less than 200° C. to not more than 240° C., more preferably 230° C.; the heating time (duration of heating time) by the third heater 37 is, for example, in a range of not less than 1 hour to not more than 20 hours, preferably in a range of not less than 4 hour to not more than 10 hours.

In such a manner described above, the heating roller 20 is produced.

Note that although the roller member 34 is prepared and then the heating roller 20 is produced from (based on) the roller member 34 in the method for producing the heating roller as described above, there is no limitation to this. It is allowable to produce the heating roller 20 from a commercially available roller member 34. Examples of the commercially available roller member 34 include a roller manufactured by SYNZTEC CO., LTD., etc.

<Details of Fixing Operation>

The heating roller 20 as described above is heated to a temperature within the fixing temperature range in the above-described fixing operation by the unillustrated temperature controller and the halogen lamp 31.

The fixing temperature range is, for example, in a range of not less than 150° C. to not more than 250° C., preferably in a range of not less than 200° C. to not more than 240° C., more preferably in a range of a temperature exceeding 200° C. to less than 230° C. Namely, the fixing temperature range includes the minute particle-scattering start temperature.

[Effect of Operation]

In the heating roller 20, the density, of minute particles having the mean particle size of not more than 300 nm, measured by the minute particle scattering test as shown in FIG. 6 is less than 2,000 pieces/$cm^3$. Accordingly, it is possible to suppress the scattering of the minute particles from the rubber layer 27 when the heating roller 20 is heated to a temperature within the fixing temperature range for the purpose of thermally fixing the toner (toner image) onto a paper P.

The fixing temperature range preferably is of more than 200° C. to less than 230° C. Namely, the fixing temperature range is lower than 230° C. that is the heating temperature in the minute particle scattering test. Accordingly, it is possible to assuredly suppress the scattering of the minute particles from the rubber layer 27 in a case that the heating roller 20 is heated to a temperature within the fixing temperature range.

Further, the rubber layer 27 shown in FIG. 3 is formed preferably of a silicone rubber. Accordingly, it is possible to improve the heat resisting property of the rubber layer 27.

Furthermore, the heat absorbing layer 29 is arranged on the inner circumferential surface of the meal raw pipe 26, as shown in FIG. 3. Accordingly, when the halogen lamp 31 heats the metal raw pipe 26 from the inside of the metal raw pipe 26, the heat absorbing layer 29 absorbs the heat beam (heat ray) efficiently. As a result, the heat absorbing layer 29 can be heated efficiently, consequently thereby heating the metal raw pipe 26 efficiently.

The heating unit 33 is provided with the heating roller 20 and the halogen lamp 31, as shown in FIG. 3. Accordingly, it is possible to suppress the scattering of minute particles from the rubber layer 27 of the heating roller 20, when the halogen lamp 31 heats the heating roller 20 to a temperature within the fixing temperature range to thereby thermally fix the toner (toner image) onto a paper P.

In the method for producing the heating roller 20, the resin composite layer 30 is subjected to the secondary curing to thereby prepare the rubber layer 27 as shown in FIGS. 4B and 4C, and then the roller member 34 provided with the metal raw pipe 26, the rubber layer 27 and the coating layer 28 is heated by the third heater 37 preferably at a temperature in a range of not less than 200° C. to not more than 250° C. for a duration of time ranging from not less than 1 hour to not more than 20 hours, as shown in FIGS. 5A and 5B. Accordingly, the minute particles of which mean particles size is not more than 300 nm scatter from the rubber layer 27 when the third heater 37 heats the roller member 34.

In other words, in the method for producing the heating roller 20, the minute particles of which mean particle size is not more than 300 nm are caused to scatter from the rubber layer 27 in advance in the production step of the heating roller 20. Accordingly, in the heating roller 20 produced by this production method, the scattering of the minute particles from the rubber layer 27 is suppressed, when the heating roller 20 is heated to a temperature within the fixing temperature range.

Namely, according to the method for producing the heating roller 20, it is possible to produce a heating roller 20 capable of suppressing the scattering of minute particles of which mean particle diameter is not more than 300 nm when being heated to a temperature within the fixing temperature range.

In the following, an example and a comparative example are shown for explaining the present teaching in further detail. The present teaching, however, is not limited to the example and the comparative example. Note that the numerical values in the example can be substituted with the upper limit value or the lower limit value of any portions described in the above-described embodiment and corresponding to those in the example.

Example 1

At first, a metal raw pipe provided with a heat absorbing layer formed of a black paint (coating) arranged on the inner circumferential surface of the metal raw pipe was prepared.

Note that the metal raw pipe was made of aluminum, and size in the left/right direction of the metal raw pipe was 270 mm. Further, the thickness of the heat absorbing layer was 10 μm.

Subsequently, an unillustrated forming die was arranged so as to cover the outer circumferential surface of the metal raw pipe, and a resin composite was poured into the unillustrated forming die. Note that the resin composite contained a silicone resin and was in liquid form.

In such a manner, a resin composite layer was formed on the outer circumferential surface of the metal raw pipe.

Next, the metal raw pipe having the resin composite layer formed thereon was accommodated and heated inside the first casing 44 of the first heater 35 shown in FIG. 4C.

Note that the heating temperature by the first heater 35 was in a range of 30° C. to 60° C., and the duration of heating time by the first heater 35 was in a range of 1 hour to 2 hours.

With this, the resin composite layer underwent the primary curing. Afterwards, the unillustrated forming die was removed.

Next, the metal raw pipe provided with the primary cured resin composite layer thereon was accommodated and heated inside the second casing 45 of the second heater 36 shown in FIG. 4C.

Note that the heating temperature by the second heater 36 was in a range of 200° C. to 240° C., and the duration of heating time by the second heater 36 was in a range of 4 hours to 8 hours.

With this, the resin composite layer underwent the secondary curing to thereby prepare a rubber layer. Further, the size in the left/right direction of the rubber layer was 240 mm and the thickness of the rubber layer was 0.5 mm.

Next, a coating layer having a substantially cylindrical shape was attached to the outer circumferential surface of the rubber layer so as to cover the rubber layer. Note that the coating layer was formed of PFA, and the size in the left/right direction of the coating layer was 240 mm and the thickness of the coating layer was 50 μm.

With this, a roller member provided with the metal raw pipe, the rubber layer, the coating layer and the heat absorbing layer was prepared.

Next, the roller member was accommodated and heated inside the third casing 46 of the third heater 37 shown in FIG. 5B.

Note that the heating temperature by the third heater 37 was in a range of 200° C. to 250° C., and the duration of heating time by the third heater 37 was in a range of 4 hours to 8 hours.

In the manner described above, the heating roller was produced.

<Evaluations>

(1) Scattering Density of Minute Particles

With respect to the heating roller of Example 1, the scattering density of minute particles was measured with the measuring unit 38 shown in FIG. 6.

At first, the air cleaner 43 was activated and the scattering density of minute particles (piece/$cm^3$) inside the casing 40 was adjusted to not more than 5 pieces/$cm^3$. Further, the hot plate 42 was activated to heat the upper surface of the hot plate 42 to 230° C.

Next, the air cleaner 43 was stopped, and then the scattering density of minute particles (piece/$cm^3$) inside the casing 40 was measured every 1 second and the measured values were stored (logging or data log) by the particle density measuring device 39.

After elapse of 20 minutes since the start of the measuring, the logging by the particle density measuring device 39 was stopped. By doing so, the background data was obtained.

Subsequently, the air cleaner 43 was activated again, and the scattering density of minute particles (piece/$cm^3$) inside the casing 40 was adjusted to not more than 5 pieces/$cm^3$.

Next, the air cleaner 43 was stopped, and then the heating roller was arranged on the hot plate 42 so that the axial direction of the heating roller was along the up/down direction and an end surface in the axial direction of the metal raw pipe made contact with the heated upper surface of the hot plate 42.

Then, the scattering density of minute particles (piece/$cm^3$) inside the casing 40 was measured every 1 second and the measured values were stored (logging) by the particle density measuring device 39.

Figure 7A:
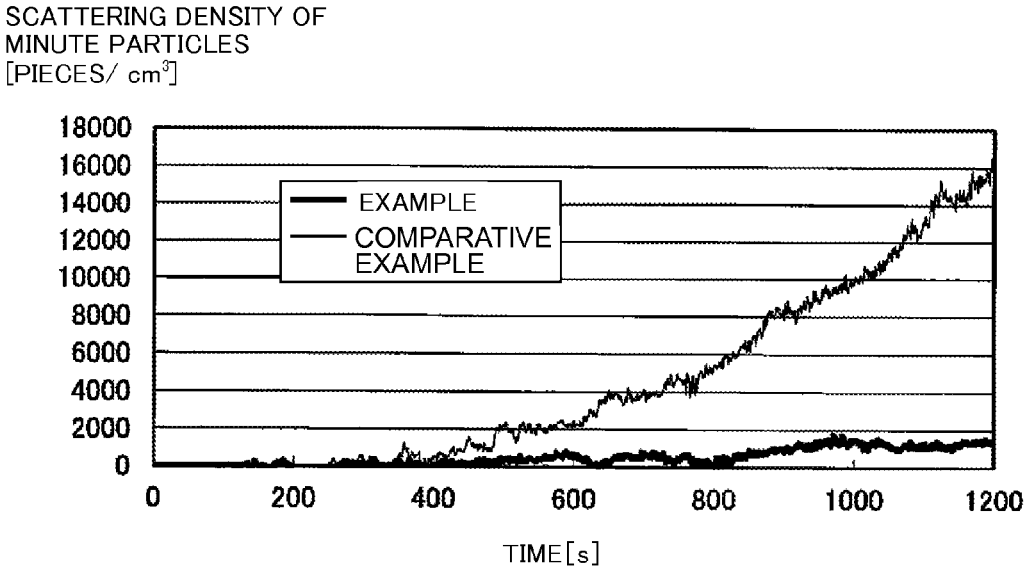
FIG. 7A is a graph showing the scattering density of minute particles with respect to the time, in Example and Comparative Example.
Figure 7B:
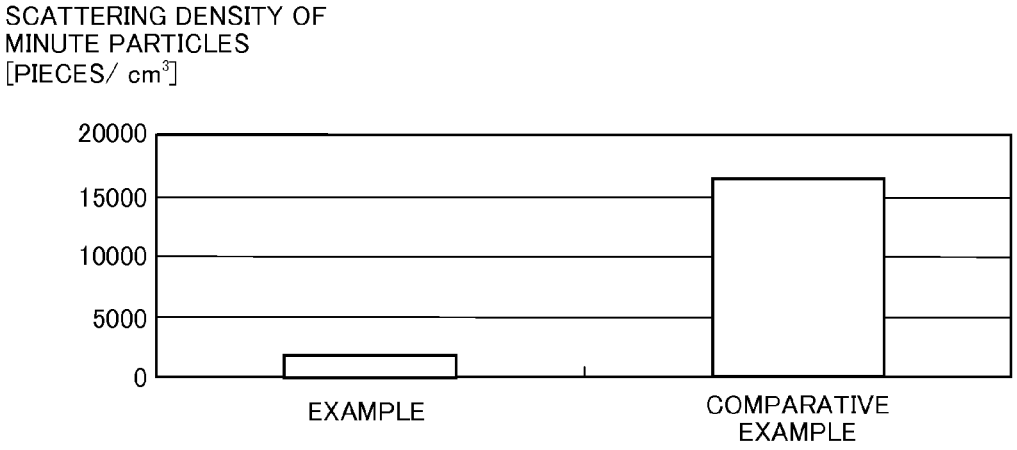
FIG. 7B is a graph showing values of the scattering density of minute particles shown in FIG. 7A, measured after elapse of 20 minutes since the start of heating, in Example and Comparative Example.

After elapse of 20 minutes since the start of the heating of the heating roller, the logging by the particle density measuring device 39 was stopped, and the obtained measurement data was corrected by the background data. The result of the correction is shown in FIG. 7A. Further, the scattering density of minute particles (piece/$cm^3$) measured at a point of time after elapse of 20 minutes since the start of heating of the heating roller is shown in FIG. 7B.

COMPARATIVE EXAMPLE 1

A roller member was prepared in a similar manner as in Example 1 described above.

<Evaluations>

(1) Scattering Density of Minute Particles

With respect to the roller member of Comparative Example 1, the scattering density of minute particles was measured with the measuring unit 38 shown in FIG. 6.

At first, the background data was obtained in a similar manner as the measurement of scattering density of minute particles in Example 1.

Subsequently, the air cleaner 43 was activated again, and the scattering density of minute particles (piece/$cm^3$) inside the casing 40 was adjusted to not more than 5 pieces/$cm^3$.

Next, the air cleaner 43 was stopped, and then the roller member was arranged on the hot plate 42 so that the axial direction of the roller member was along the up/down direction and an end surface in the axial direction of the metal raw pipe made contact with the heated upper surface of the hot plate 42.

Then, the scattering density of minute particles (piece/$cm^3$) inside the casing 40 was measured every 1 second and the measured values were stored (logging) by the particle density measuring device 39.

After elapse of 20 minutes since the start of the heating of the roller member, the logging by the particle density measuring device 39 was stopped, and the obtained measurement data was corrected by the background data. The result of the correction is shown in FIG. 7A. Further, the scattering density of minute particles (piece/$cm^3$) measured at a point of time after elapse of 20 minutes since the start of heating of the roller member is shown in FIG. 7B.

(2) Minute Particle-Scattering Start Temperature

With respect to the roller member of Comparative Example 1, the minute particle-scattering start temperature was measured with the measuring unit 38 shown in FIG. 6.

At first, the air cleaner 43 was activated and the scattering density of minute particles (piece/$cm^3$) inside the casing 40 was adjusted to not more than 5 pieces/$cm^3$. Further, the hot plate 42 was activated to heat the upper surface of the hot plate 42 to 180° C.

Next, the air cleaner 43 was stopped, and then the roller member was arranged on the hot plate 42 so that the axial direction of the roller member was along the up/down direction and an end surface in the axial direction of the metal raw pipe made contact with the heated upper surface of the hot plate 42.

Subsequently, the roller member was heated for 10 minutes, and then the scattering density of minute particles (piece/$cm^3$) inside the casing 40 was measured by the particle density measuring device 39. The scattering density of the minute particles at this point of time was 1,913 pieces/$cm^3$.

Next, the temperature of the upper surface of the hot plate 42 was raised by 20° C. (predetermined value) so that the upper surface was heated to 200° C., and was made to stand still for 10 minutes.

Afterwards, the scattering density of minute particles (piece/$cm^3$) inside the casing 40 was measured again by the particle density measuring device 39. The scattering density of the minute particles at this point of time was 544 pieces/$cm^3$.

Next, the temperature of the upper surface of the hot plate 42 was raised further by 20° C. so that the upper surface was heated to 220° C., and was made to stand still for 10 minutes.

Afterwards, the scattering density of minute particles (piece/$cm^3$) inside the casing 40 was measured again by the particle density measuring device 39. The scattering density of the minute particles at this point of time was 35,803 pieces/$cm^3$.

At this point of time, since the scattering density of the minute particles exceeded 5,000 pieces/$cm^3$, the temperature of 200° C., obtained by subtracting 20° C. (predetermined value) from 220° C. that was the temperature of the upper surface of the hot plate 42, was confirmed as the minute particle-scattering start temperature.

Figure 8:
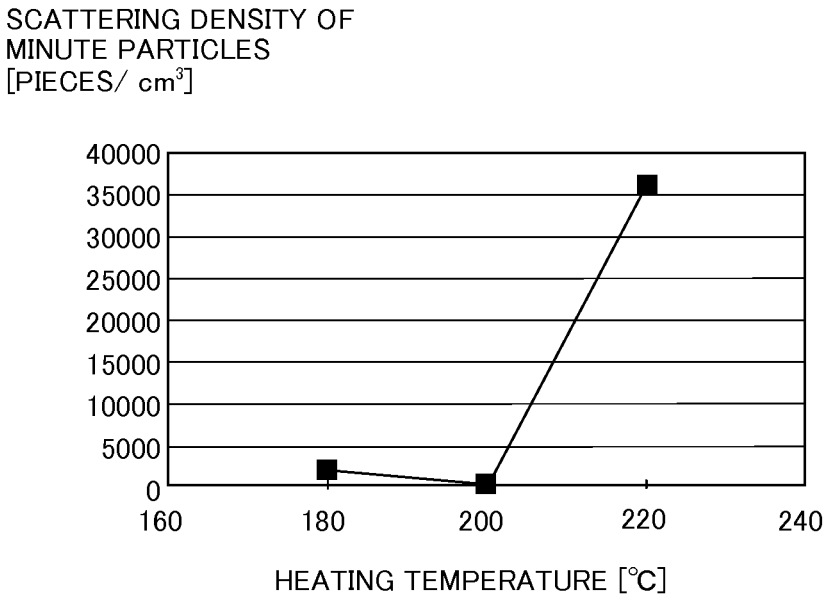
FIG. 8 is a graph showing the scattering density of minute particles with respect to the heating temperature, in Comparative Example.

The result of the above is shown in FIG. 8.

What is claimed is:

1. A heating roller comprising:

a core bar having a cylindrical shape;

a rubber layer formed by:

forming a resin composite layer formed of a resin composite on an outer circumferential surface of the core bar to cover the core bar;

performing primary curing of the resin composite layer at a temperature in a range of not less than 25° C. to not more than 150° C. for a duration of time in a range of not less than 0.5 hours to not more than 4 hours; and performing secondary curing of the resin composite layer, after the primary curing, at a temperature in a range of not less than 150° C. to not more than 230° C. for a duration of time in a range of not less than 0.5 hours to not more than 10 hours; and a release layer arranged on an outer circumferential surface of the rubber layer, wherein in a case that a developer is thermally fixed on a recording medium, the heating roller is heated to a temperature within a fixing temperature range including a minute particle-scattering start temperature at which minute particles having mean particle diameter of not more than 300 nm start to scatter from the rubber layer, the minute particles originating from the rubber layer scatter from the rubber layer in a test and density of the minute particles measured in the test is less than 2,000 pieces/$cm^3$, the test being executed by: arranging the heating roller inside a casing of which inner volume is 0.175 $m^3$ and which is connected to a minute particle density measuring device configured to measure the density of the minute particles; then performing heating of the core bar of the heating roller inside the casing to 230° C. by a heater; and then measuring the density of the minute particles inside the casing after elapse of 20 minutes since start of the heating of the core bar, and the heating roller is heated at a temperature in a range of not less than 200° C. to not more than 250° C. for a duration of time in a range of not less than 1 hour to not more than 20 hours before the test.

2. The heating roller according to claim 1, wherein the fixing temperature range is not less than 150° C. to less than 230° C.

3. The heating roller according to claim 1, wherein the rubber layer is formed of a silicone rubber.

4. The heating roller according to claim 1, further comprising a heat absorbing layer arranged on an inner circumferential surface of the core bar.

5. A thermal fixing apparatus comprising:

a heating roller as defined in claim 1; and a heating member arranged inside the core bar of the heating roller and configured to heat the heating roller to a temperature of less than 230° C.

* * * * *